United States Patent [19]

Riebock et al.

[11] 3,978,904

[45] Sept. 7, 1976

[54] KNOTLESS MASTER CARRIER

[75] Inventors: William D. Riebock, Rockford; Delbert B. Graves, Nora, both of Ill.

[73] Assignee: Newell Companies, Inc., Freeport, Ill.

[22] Filed: May 14, 1975

[21] Appl. No.: 577,337

[52] U.S. Cl. ..... 160/345; 160/126

[51] Int. Cl.[2] ..... A47H 15/00

[58] Field of Search ..... 160/344–347, 160/123–126; 16/87–87.8, 93 D

[56] References Cited

UNITED STATES PATENTS

| | | | |
|---|---|---|---|
| 3,040,373 | 6/1962 | Graber et al. | 160/126 X |
| 3,192,995 | 7/1965 | Graber et al. | 160/345 |
| 3,424,225 | 1/1969 | Magnusson | 160/345 |

*Primary Examiner*—Philip C. Kannan

*Attorney, Agent, or Firm*—Leydig, Voit, Osann, Mayer & Holt, Ltd.

[57] ABSTRACT

In a traverse rod assembly, a draw cord is trained around rollers at opposite ends of the rod with an intermediate portion of the cord also being trained around a tensioning device. The two opposite end portions of the cord are secured to a master carrier which is slidable back and forth on the rod from one end thereof to the middle of the rod. Each end portion of the cord is fastened to the carrier in essentially the same manner with a bight being formed in the end portion of the cord and around a finger projecting rearwardly from the backside of the carrier so that, upon progressing from the end of the cord, the leading end of the bight overlaps the trailing end of the bight thereby holding the trailing end of the cord against the backside of the carrier. From the bight, the cord is trained reversely through a wedge slot formed through the center portion of the carrier adjacent the finger and extends toward the roller at the adjacent end of the rod. The slot is tapered, narrowing upon progressing toward the finger, so that the cord wedges in the slot when tension is applied to the cord thereby anchoring the cord to the carrier.

8 Claims, 7 Drawing Figures

KNOTLESS MASTER CARRIER

BACKGROUND OF THE INVENTION

This invention relates to a traverse rod assembly of the type adapted to support a draw curtain on a rod for back and forth sliding movement between open and closed positions by pulling on one end or the other of a draw cord which is connected to a suitable master carrier supporting the curtain on the rod. More particularly, the invention relates to a traverse rod assembly including a master carrier to which opposite ends of the draw cord are secured without the use of knots. One traverse rod assembly including a master carrier of this type is disclosed in Graber et al U.S. Pat. No. 3,192,995.

SUMMARY OF THE INVENTION

The primary object of the present invention is to provide a new and improved traverse rod assembly of the foregoing general character which is uniquely adapted to substantially reduce the time required to put together the parts assembly and which, once assembled, is much less likely to come apart during shipping than prior similar traverse rod assemblies. A more detailed object is to accomplish the foregoing through the provision of a novel master carrier which is constructed so that the opposite ends of the cord may be fastened securely to the carrier much more quickly and easily than is possible with prior carriers by eliminating the need for tying knots in the cord for the use of clips or other complicated means for securing the ends of the cord to the master carrier. A still further object is to achieve the foregoing while also providing a master carrier in which the ends of the cord may be loosened and resecured to the carrier very quickly and easily for adjustment in the length of the cord during installation of the traverse rod assembly.

The invention also resides in the unique construction of wedge slots and rearwardly projecting fingers in the master carrier and the novel manner in which these two parts cooperate with the cord in fastening the ends of the cord to the carrier so that increased tension anchors the cord even more securely to the carrier.

Still further the invention resides in the novel construction of the wedge slots and the fingers to keep the cord from being accidently dislodged from the carrier during shipping.

These and other objects and advantages of the present invention will become more apparent from the following detailed description when taken in conjunction with the accompanying drawings.

DETAILED DESCRIPTION OF THE PREFERRED EMBODIMENT

Figures 1, 2, 3, 4, 5, 6, 7:
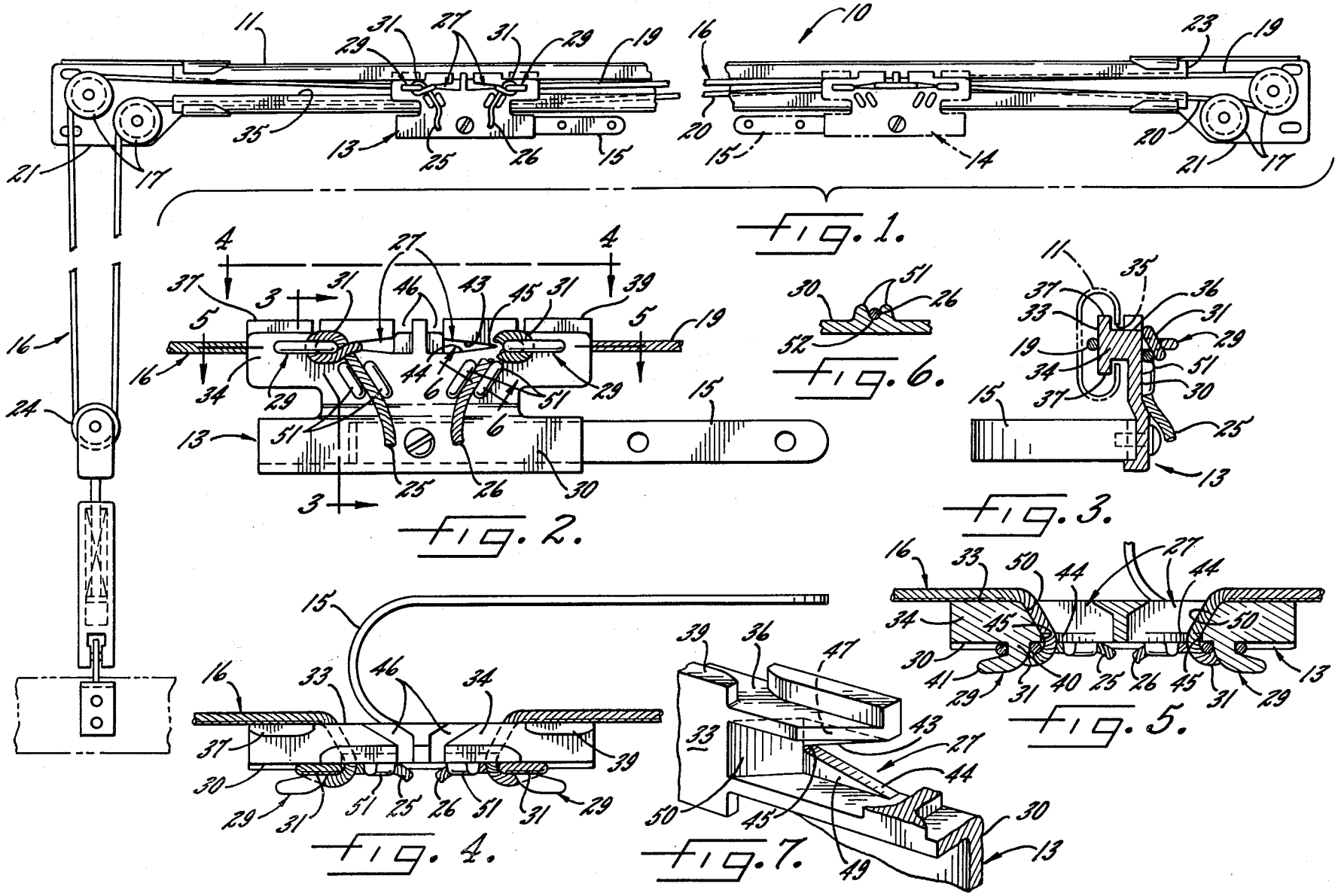
FIG. 1 is a fragmentary elevational view of the backside of a traverse rod assembly embodying the novel features of the present invention.
FIG. 2 is an enlarged elevational view of the backside of a part of the assembly shown in FIG. 1.
FIG. 3 is a cross-sectional view taken substantially along line 3—3 of FIG. 2.
FIG. 4 is a view taken substantially along line 4—4 of FIG. 2.
FIG. 5 is a cross-sectional view taken substantially along line 5—5 of FIG. 2.
FIG. 6 is a fragmentary cross sectional view taken substantially along line 6—6 of FIG. 2.
FIG. 7 is an enlarged fragmentary perspective view showing a portion of the front side of the part of the assembly shown in FIG. 2.

As shown in the drawings for purposes of illustration, the present invention is embodied in a traverse rod assembly 10 suitable for use in supporting a draw curtain (not shown) for movement along a rod 11. Herein, the rod is a channel-shaped member such as is shown in FIGS. 1 and 3 with curtain carriers 13 and 14 mounted therein for movement toward and away from each other on the rod. The adjacent ends of the two halves of the curtain are fastened to arms 15 projecting outwardly of the carriers and generally toward each other so that, as the carriers are slid back and forth on the rod, the curtain is opened and closed.

More particularly, to move the carriers 13 and 14 back and forth along the rod 11, a draw cord 16 is looped double through the rod and is trained around rollers 17 located at opposite ends of the rod. One of the carriers is fastened to the upper strand 19 of the cord loop extending through the rod while the other carrier is fastened to the lower strand 20. In this way, when the cord is pulled in one direction or the other, the carriers move in opposing directions with respect to each other.

As shown in FIG. 1, there are two of the rollers 17 located at each end of the rod, the rollers being spaced both vertically and horizontally of each other and journaled within mounting brackets 21. The latter are fastened to the opposite ends of the rod and are adapted for mounting on a wall (not shown). At one end 23 of the rod, both the strands 19 and 20 of the cord are trained around the upper roller while, at the other end of the rod, the upper strand is trained over the upper roller and the lower strand over the lower roller, with both of the strands extending downwardly to loop around a spring loaded pulley 24 normally secured to the wall. Thus, the cord 16 forms a closed loop within the assembly 10 with the wall pulley serving to maintain tension in both strands of the cord so that movement of the carriers 13 and 14 to open and close the curtain is achieved by pulling downwardly on one or the other of the vertical strands of the cord.

To form the closed loop with the cord 16, opposite ends 25 and 26 of the cord are fastened to the carrier 13 which herein-after is referred to as the master carrier. In accordance with the primary aspect of the present invention, provision is made of a particularly unique master carrier 13 especially adapted so that the ends of the cord may be secured easily and quickly to it without need of tying knots in the ends of the cord or the use of clips or other complicated and time consuming fastening arrangements. For these purposes, a wedge slot 27 is formed through the carrier adjacent a finger 29 projecting outwardly from one side 30 of the carrier. When fastening one end portion 25 of the cord to the carrier, a bight 31 is formed around the finger so as to hold the end portion of the cord against the side of the carrier. Thereafter, the cord is threaded from the bight through the wedge slot and reversely along the other side 33 of the carrier wedging the cord in the slot and thereby anchoring the cord to the carrier. The other end portion 26 of the cord is fastened to the carrier in a similar manner by way of a second similar wedge slot 27 and finger 29. By virture of this arrangement, the opposite end portions 25 and 26 of the cord may be fastened quickly and easily to the master carrier 13 without the need of the knots, clips or other complicated fastening arrangements so as to reduce substantially the time required to put the assembly together during manufacture. Moreover, when installing the traverse rod assembly, the cord ends may be loosened and resecured to the master carrier very quickly and easily for adjustment in the length of the cord to obtain the proper tension.

In the present instance, the master carrier 13 is generally rectangular in shape and includes an elongated runner 34 adapted to ride within the slot 35 in the support rod 11 of the assembly 10. More particularly, as shown in FIG. 3, the runner is integrally formed with the carrier, projecting in an inward direction from the front side 33 of the carrier along the upper edge 36 thereof. Extending vertically from the runner are longitudinally spaced sets of guides 37 and 39 serving to retain the carrier against lateral movement out of the rod slot. Secured to the lower margin of the carrier is the curtain arm 15 which, in the present instance, is formed as a hook projecting first inwardly from the front side of the carrier and then forwardly for connection to the leading end of one half of the curtain.

Integrally formed with the backside 30 of the carrier 13 are two of the fingers 29. Herein, the fingers are spaced from each other, being located intermediate the opposite ends of the carrier and adjacent the upper edge of the carrier opposite the runner 34. More particularly, each finger is formed with a base portion 40 projecting outwardly from the carrier in a direction generally perpendicular to the backside thereof for a distance slightly greater than the normal thickness of the cord (see FIG. 3). An outer end portion 41 of each finger is hooked away from the other finger and generally toward the adjacent end of the carrier. By virtue of this construction, when the ends 25 and 26 of the cord 16 are fastened around the fingers, the cord is kept from being easily pulled rearwardly off the fingers without first loosening the bight 31 from around the fingers.

As shown in FIG. 2, two of the wedge slots 27 are formed through the carrier 13 between the two fingers 29, each slot extending through the runner 34 and being associated with one of the fingers. More particularly, each slot is generally triangular in shape with upper and lower edges 43 and 44 converging upon each other upon progressing toward the associated finger of that slot so that the width of the slot adjacent such finger is narrower than the normal thickness of the cord. Accordingly, when the cord is wedged into the narrowed end 45 of the slot, the cord is held against being easily pulled loose from the carrier.

Advantageously, an opening 46 extends through the upper edge of the carrier 13 and communicates with the opposite end of each slot 27 (see FIG. 2) to allow the cord 16 to be threaded broadwise into the slot when securing the cord to the carrier. Herein, the interior of each slot is defined by vertically extending, upper and lower, triangular wall surfaces 47 and 49, respectively, intersecting with the upper and lower edges 43 and 44 of the slot as is shown in FIG. 7. By virtue of this construction, a relief area is provided for each of the edges of the slot so that the cord will wedge more tightly in the end of the slot when being fastened to the carrier. In addition, an upright, interior wall 50 of each slot extends generally across the carrier from the tapered end 45 of the slot toward the front side 33 of the carrier so as to form an acute included angle with the backside 30 of the carrier (also see FIG. 5). Accordingly, when threaded through the slot 27, the cord follows the contour of the wall 50, forming an acute angle across the tapered end of the slot so as to wedge more tightly within the slot.

To aid in fastening the cord 16 to the carrier 13, two pairs of spaced elongated bosses 51 are integrally formed with the backside 30 of the carrier to guide the cord for wrapping around the fingers 29. Herein, one pair of the bosses is located adjacent each slot, the bosses extending in a generally vertical direction across the backside of the carrier and defining a channel 52 whose width is approximately equal to the diameter of the cord. More particularly, each channel is slanted upwardly and outwardly so that the centerline of the channel intersects with the space between the finger and its associated wedge slot thereby to guide the cord to be wrapped around the finger in the proper direction to form the bight 31.

To secure the cord 16 to the carrier 13, the end portions 25 and 26 of the cord are held against the backside 30 of the carrier below the slots 27 and within the channels 52 and the cord ends are wrapped around the fingers 29 to form the bights 31. Thereafter, the cord ends are trained reversely through the wedge slots and are pulled tight to anchor in the slots. More particularly, such as is shown in the left-hand side of the carrier 13 as viewed in FIG. 2, the end portion 25 of the cord is wrapped counterclockwise around the finger with the bosses 51 guiding the cord toward the finger so that, when wrapped around the finger, the leading portion of the cord overlaps the trailing end portion to hold the latter against the backside of the carrier. The intermediate portion of the cord is then threaded broadwise through the opening 46 and into the slot 27 and is bent reversely from the slot along the front side 33 of the carrier. To complete fastening of the cord to the carrier, the cord is pulled taut thereby wedging the cord in the tapered end 45 of the slot with the upper and lower edges 43 and 44 biting into the cord to keep it from coming loose from the carrier. The other end portion 26 of the cord is fastened in a similar manner to the other finger 29 on the right-hand side of the carrier, but with the cord being wrapped around that finger in a clockwise direction before being threaded reversely though the associated slot 27. With the cord being fastened to the carrier in this fashion, the cord is kept from accidentally dislodging during shipping and, in service use, as the tension in the cord is increased, the cord wedges even more securely within the slot.

Thus, it is seen from the foregoing that, the present invention brings to the art a new and improved traverse rod assembly 10 in which the opposite ends 25 and 26 of the draw cord 16 may be anchored quickly and easily to the master carrier 13 without need of tying knots in the cord or without need of clips or other special and complicated fastening arrangements. Advantageously, this is accomplished by virtue of the unique construction of the master carrier so as to include the two rearwardly extending fingers 29 and the two wedge slots 27 associated with those fingers. By forming the bights 31 in the ends of the cord around the fingers and then threading the end portions of the cord from the fingers reversely through the slots to wedge in the tapered ends 45 thereof, the ends of the cord may be fastened quickly and easily to the carrier without worry of the cords coming loose during shipping. Moreover, this particular arrangement permits the cords to be loosened easily to adjust the length of the cord when installing the assembly.

We claim as our invention:

1. In a transverse rod assembly having a support rod, a master carrier slidably supported on said rod, a draw cord threaded along said rod and having at least one free end portion fastened to said master carrier, the improvement in said assembly comprising a finger connected to and projecting outwardly from one side of said carrier, a slot associated with said finger and being formed through said carrier, said slot having one end located adjacent said finger, and a bight formed in said one free end of said cord, around said finger with said one end portion of said cord against the one side of said carrier, said cord being threaded from said bight over said one end portion and then reversely through said slot and along the opposite side of said carrier with said cord being wedged against said one end of said slot thereby anchoring said one end portion of said cord to said carrier.

2. In a traverse rod assembly having a support rod, a master carrier slidably supported on said rod, a draw cord threaded along said rod and having first and second free end portions fastened to said master carrier, the improvement in said assembly comprising first and second spaced fingers integrally formed with said carrier and projecting outwardly from one side thereof, one of said fingers being located adjacent one end of said carrier and the other of said fingers being located adjacent the opposite end of said carrier, each of said fingers having an outer end portion hooked toward the adjacent end of said carrier, first and second slots associated with said first and second fingers, respectively, and being formed through said carrier between said fingers, said slots having end portions tapering narrower than the normal thickness of said cord upon progressing toward their associated fingers, a first bight formed in said first free end portion of said cord around said first finger with the end portion of said cord against the one side of said carrier, said cord being threaded from said first bight over said first free end portion and then reversely through said first slot and along the opposite side of said carrier to wedge said cord in the tapered end of said first slot thereby anchoring the one end portion of the cord to the carrier, and a second bight similarly formed in the second free end portion of said cord and around said second finger with the end portion against the one side of said carrier and with the cord extending over the end portion and then being threaded through said second slot and wedged into the tapered end portion thereof to anchor the second end portion of said coil to the carrier in a similar manner.

3. In a traverse rod assembly having a support rod, a master carrier slidably supported on said rod, a draw cord threaded along said rod and having opposite free end portions fastened to said master carrier, the improvement in said assembly comprising first and second spaced fingers integrally formed with said carrier and projecting outwardly from one side thereof, first and second wedge slots formed through said carrier and being associated with said first and second fingers, respectively, said slots tapering narrower than the normal thickness of said cord upon progressing toward their associated fingers, a first bight formed in one end portion of said cord around said first finger with said one free end portion of said cord against the one side of said carrier, said cord being threaded from said bight over said one free end portion and then reversely through said first slot and along the opposite side of said carrier to wedge said cord in the tapered end of said first slot thereby anchoring the one end portion of the cord to the carrier, and a second bight similarly formed in the opposite free end portion of said cord and around said second finger with said opposite end portion against the one side of said carrier and with the cord extending over said opposite end portion and then being threaded through said second slot and wedged into the tapered end portion thereof to anchor the opposite end of said cord to the carrier in a similar manner.

4. A traverse rod assembly as defined by claim 3, wherein said first and second wedge slots are formed between said first and second fingers and adjacent one edge of said carrier, and including first and second openings formed through the one edge of said carrier and communicating with said first and second slots, respectively, so the cord may be inserted broadwise through said openings and into said slots.

5. A traverse rod assembly as defined by claim 4 including a pair of bosses integrally formed with said one side of the carrier adjacent each of said fingers to guide said opposite end portions of said cord toward said first and second fingers.

6. A traverse rod assembly as defined by claim 5 wherein each of said slots is generally triangular in shape on said one side of said carrier and including upper and lower edges converging on each other toward said adjacent finger, upper and lower vertically extending, generally triangular interior wall surfaces intersecting with said upper and lower edges, respectively.

7. A traverse rod assembly as defined by claim 6 wherein each of said slots further includes a generally upright interior wall extending across said carrier from said one side thereof to the other and joining with the tapered end of said slot to form an acute included angle between said upright wall and said one side of said carrier.

8. A traverse rod assembly as defined by claim 4 wherein each of said fingers includes a base portion extending in a generally perpendicular direction outwardly from said one side of said carrier, and an outer end portion integrally formed with said base portion and extending therefrom generally toward the adjacent end of said carrier whereby said fingers are hooked away from their associated slots.

* * * * *